United States Patent [19]

Miwa et al.

[11] 4,149,112

[45] Apr. 10, 1979

[54] SYSTEM FOR CONTROLLING A SELF-SHIFT TYPE GAS DISCHARGE DISPLAY DEVICE

[75] Inventors: Hirohide Miwa; Toshiaki Terakawa, both of Kawasaki, Japan

[73] Assignee: Fujitsu Limited, Japan

[21] Appl. No.: 850,680

[22] Filed: Nov. 11, 1977

[30] Foreign Application Priority Data

Nov. 16, 1976 [JP] Japan ..... 51/138058
Nov. 16, 1976 [JP] Japan ..... 51/138059

[51] Int. Cl.[2] ..... H05B 37/00; H05B 39/00; H05B 41/00

[52] U.S. Cl. ..... 340/768; 340/779; 340/792; 315/169.4

[58] Field of Search ..... 315/169 R, 169 TV; 340/324 M

[56] References Cited

U.S. PATENT DOCUMENTS 3,710,180 1/1973 Rooks ..... 315/169 TV X 3,944,875 3/1976 Owaki et al. ..... 315/169 TV

*Primary Examiner*—Alfred E. Smith
*Assistant Examiner*—Robert E. Wise
*Attorney, Agent, or Firm*—Staas & Halsey

[57] ABSTRACT

A system for controlling a gas discharge display device having column electrodes periodically connected, a plurality of bus-lines; row electrodes connected in common and arranged transversely to and facing the column electrodes across a discharge gap, WRITE electrodes arranged at one or both ends of the row electrodes, a driver to apply shift pulses sequentially to the plurality of bus-lines, a WRITE driver to apply write pulses to the WRITE electrodes, and a control circuit to reverse the order of the shift pulses. Information is written into the device by selecting WRITE electrodes at one or both ends of each row electrode, and the shift direction of the written information is controlled by reversing the order of the shift pulses which are applied to the bus-lines by means of the control circuit.

11 Claims, 11 Drawing Figures

SYSTEM FOR CONTROLLING A SELF-SHIFT TYPE GAS DISCHARGE DISPLAY DEVICE

BACKGROUND OF THE PRESENT INVENTION

1. Field of the Invention

This invention relates to a system for controlling a gas discharge display device for shifting discharge spots and more precisely, to a system for controlling the direction of the shifting.

2. Description of the Prior Art

The dot matrix type display device, called a plasma display panel, is one of the known display devices utilizing gas discharge. The conventional plasma display panel is described in various publications, for example, U.S. Pat. No. 3,499,167 entitled "Gas discharge display memory device and method of operating" by Baker et al., and U.S. Pat. No. 3,559,190 entitled "Gaseous display and memory apparatus" by Bitzer et al. Such a plasma display panel comprises a discharge space filled with gas capable of ionization and arrays of X and Y electrodes arranged and connected in matrix form so as to provide many elemental discharge cells or discharge points in the display panel. A major characteristic feature is a memory function due to the wall charge which accumulate at the discharge points on insulating layers covering the electrodes. However, the circuit for driving this plasma display panel requires one address circuit for each X and Y electrode. As these address circuits are required to scan sequentially, the peripheral circuit of this plasma display panel becomes very complex and expensive. In this connection, the conventional plasma display panel is disadvantageous compared with other devices such as cathode ray tube display devices.

Another display device utilizing gas discharge employs self scanning as a means for resolving the above-mentioned inconveniences of the peripheral circuit, known as a "Self Scan (Trademark) device". This kind of display device, as described, for example, in ELECTRONICS (in u.s.a.) Vol. 43, No. 5, P120–P125, comprises double construction of the scanning part and the display part. Discharge spots are moved along each line of the scanning part on the rear face, which is used as an exciting source. The discharge spots are scanned and selectively taken to the display part on the front face, in accordance with the position of said discharge spot, and thereby the display action is carried out.

However, the above-mentioned type of display device utilizing gas discharge has various disadvantages. The construction of a wall, for separating the scanning part and the display part, and the construction of the electrodes is complicated and is not suited to mass production. Also the life of each electrode exposed directly to the discharge space is short, and an external memory for refreshing the display spots is necessary. Further the brightness of the display part decreases as the number of picture elements increases.

Still another display device, which is called the "Self shift type plasma display panel," is disclosed in U.S. Pat. No. 3,944,875 entitled "Gas discharge device having a function of shifting discharge spots" by Owaki et al.

Such a self shift type plasma display panel comprises a discharge space filled with gas capable of ionization, at least one row electrode and a plurality of column electrodes positioned in the direction transverse to the row electrodes.

However, the shifting of discharge spots is conventionally provided for in only one direction, so that when it is necessary to correct written information the content of the entire line containing the errors must be rewritten. Accordingly, when miswritten parts are discovered in the written information, the portion which is incorrectly written should be rewritten. Further, since the conventional self-shift always occurs in one direction, when it is necessary to display a few characters at the end opposite from the WRITE electrodes the written characters must be shifted there from the WRITE electrodes. Also, the information which is written to the device is frequently required to be transferred to and READ by a separate information processing device.

SUMMARY OF THE INVENTION

An object of the present invention is to provide a system for controlling a self-shift type gas discharge display device such as that disclosed in U.S. Pat. No. 3,944,875, whereby information is easily rewritten by automatically shifting backward one character when miswritten information is found.

A further object of the present invention is to provide a self-shift type gas discharge display device whereby information can be written from either end, that is, from the right end or from the left end of the row electrodes of the device, and further from which the written information can be read.

This invention involves an improvement in a system for controlling the shifting of discharge spots in a discharge gas display panel comprising column electrodes connected to a plurality of bus lines, row electrodes arranged at right angles thereto, an insulating layer covering at least either said row or column electrodes and write electrodes at either or both ends of the row electrodes, the invention comprising driver means for applying shift pulses to the plurality of bus lines, write driver means for applying write pulses to the write electrodes, and control means for shifting the already written discharge spots in forward and reverse directions along the row electrodes and for stopping the shifting in correspondence with the number of prior shifts.

Further features and advantages of the present invention will be apparent from the ensuing description with reference to the drawings, which are not intended to limit the scope of the invention.

DETAILED DESCRIPTION OF THE PREFERRED EMBODIMENTS

Figure 1:
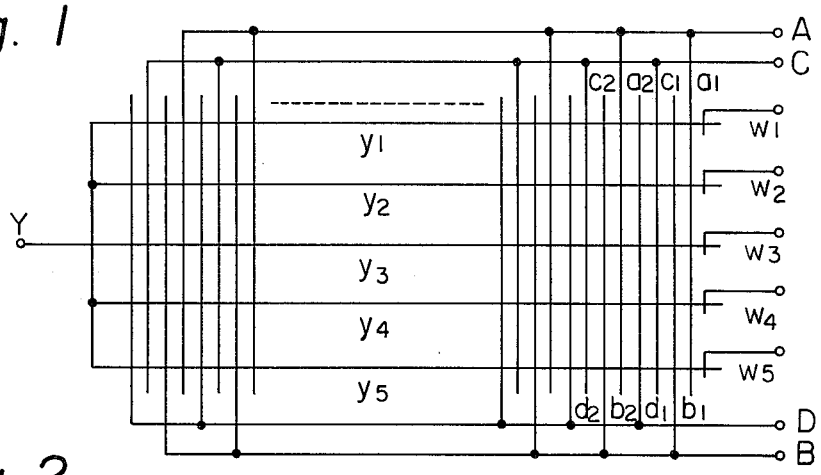
FIG. 1 shows an arrangement of the electrodes in a first embodiment of the self-shift type gas discharge device according to the present invention.

Referring to FIG. 1, an arrangement of the electrodes in a first embodiment is shown having column electrodes $a_i$ to $d_i$ (i=1, 2, 3, . . .) connected sequentially and periodically to bus-lines A, B, C and D, WRITE electrodes $W_j$ (j=1, 2, 3, . . .), both having arranged on one base plate, and row electrodes $Y_i$ (i=1, 2, 3, . . .) commonly connected in common to a bus line Y arranged on the other base plate. The row electrodes and the column electrodes face each other across a gap which is filled with discharge gas.

Figure 2:
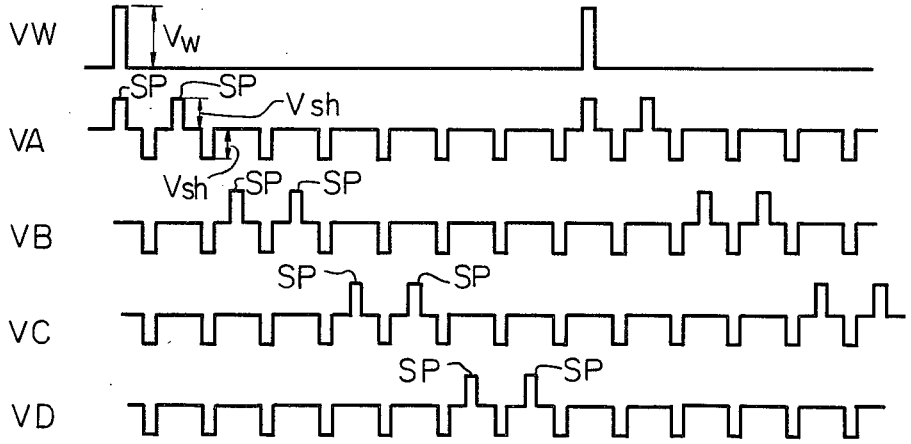
FIG. 2 shows waveforms produced in the device shown in FIG. 1.

Referring to FIG. 2, VW is a waveform of a voltage which is supplied to a WRITE electrode selected in accordance with input information, and $V_A$, $V_B$, $V_C$ and $V_D$ are respective waveforms of voltages which are supplied across the intersection points of the column electrodes ($a_i$ to $d_i$) and of the row electrodes ($Y_i$). As is well-known in the conventional self-shift type gas discharge display device, the information is displayed by writing and shifting the discharge spots by applying the voltages $V_W$, $V_A$, $V_B$, $V_C$ and $V_D$ to the WRITE electrode and to the bus-lines A, B, C and D, respectively.

Figure 3:
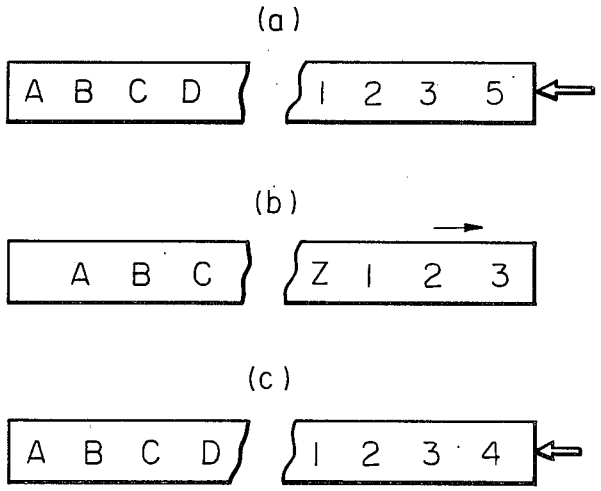
FIGS. 3 (a), (b) and (c) show the steps of the correction process for correcting a miswritten character by using the device according to the present invention.

In the self-shift type gas discharge display panel shown in FIG. 1, the characters written in the device are shifted from right to left as shown in (a) of FIG. 3. Suppose the character "5" is a miswritten character. It is then replaced by the correct character "4" as shown in (c) of FIG. 3, wherein one character was shifted to the right as shown in (b) of FIG. 3 by reversing the order of the shift pulses which are applied to the bus-lines A, B, C and D. Next, the correct character "4" is written and the correct information is displayed as shown in (c) of FIG. 3. Therefore, it is not necessary to rewrite all information corresponding to the entire line which contains the errors as in the conventional device, and correction of the miswritten character can be accomplished very easily.

Figure 4:
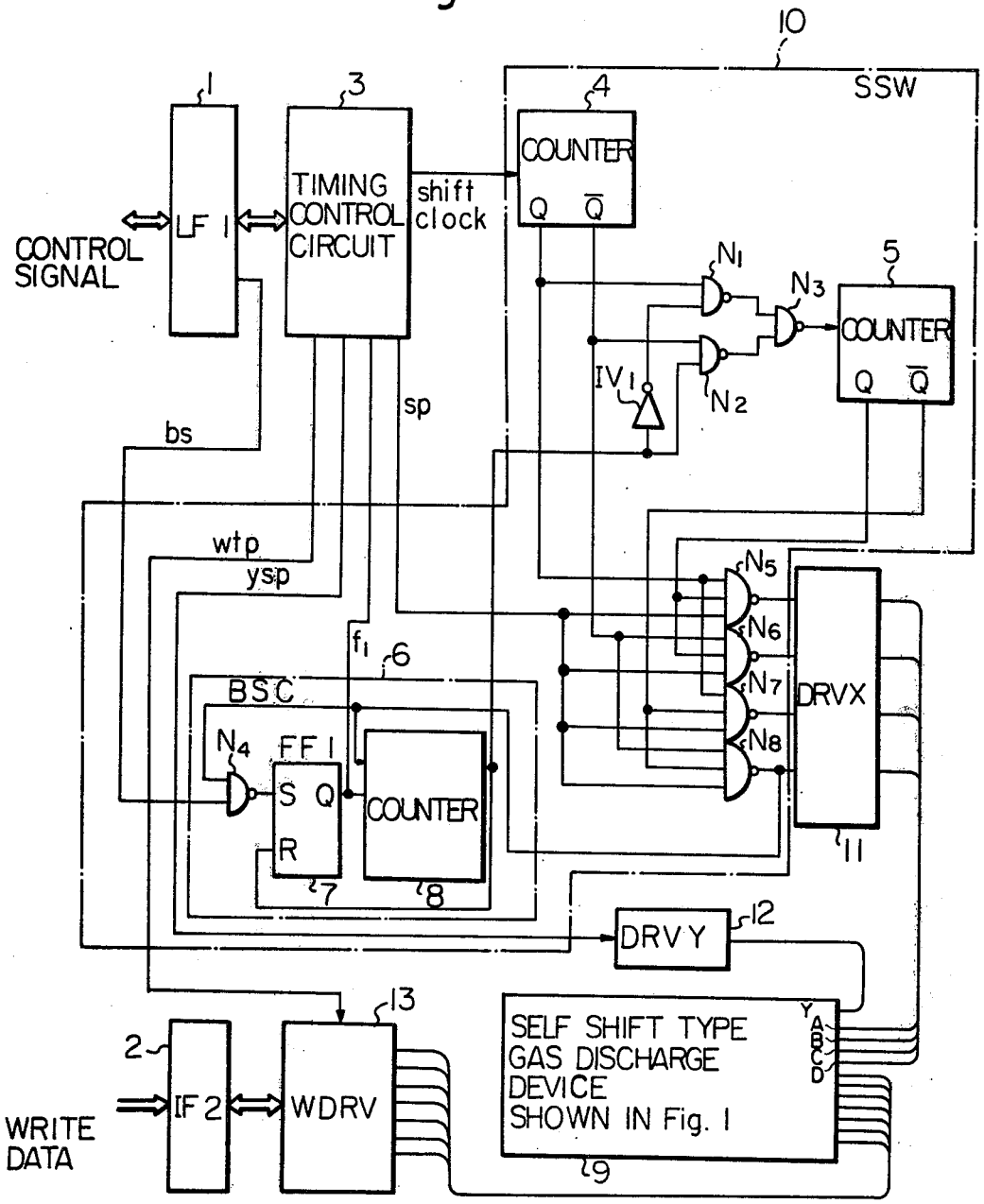
FIG. 4 is a block diagram of a driving circuit according to the present invention for the first embodiment of the self-shift gas discharge device shown in FIG. 1.

As shown in FIG. 4, a driving circuit for the embodiment of FIG. 1 is composed of interfaces 1, 2 to which control data or WRITE data is supplied from a keyboard (not shown in the drawing) or the like, a timing control circuit 3, digital counters 4 and 5, a circuit 6 which controls the direction of the self-shift of the discharge spots comprising a flip-flop 7 and a counter 8, a self-shift type gas discharge display panel 9, drivers 11 and 12 for driving the bus-lines A, B, C, D and Y, a WRITE driver 13 for supplying write pulses to the WRITE electrodes, NAND circuits $N_1$ through $N_8$, and an inverter $IV_1$.

Figure 5:
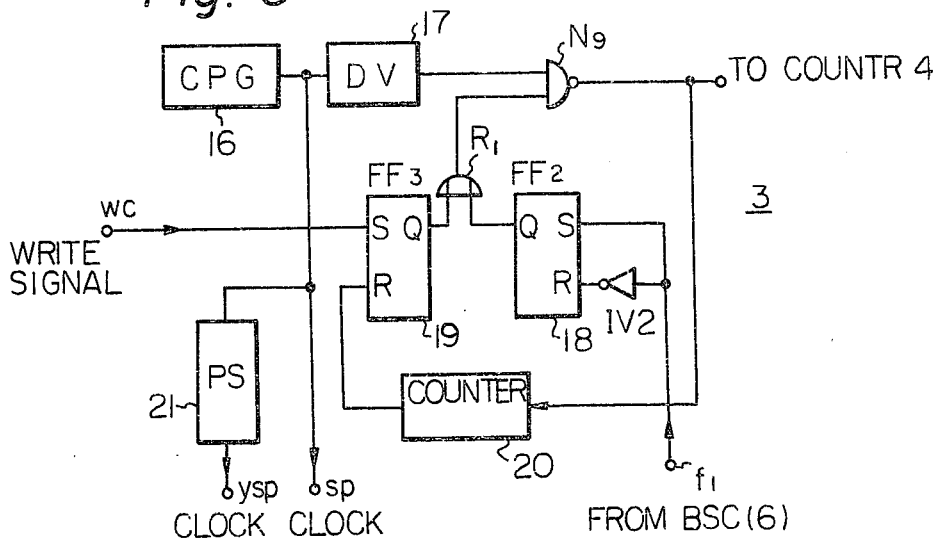
FIG. 5 is a block diagram of the timing control circuit shown in the block diagram of FIG. 4.

The timing control circuit 3 is composed of, as shown in FIG. 5, a clock pulse generator 16, a frequency divider 17, flip-flop circuits 18, 19, a counter 20, a phase shifter 21, an inverter $IV_2$, a NAND circuit $N_9$ and an OR circuit $R_1$.

Figure 6:
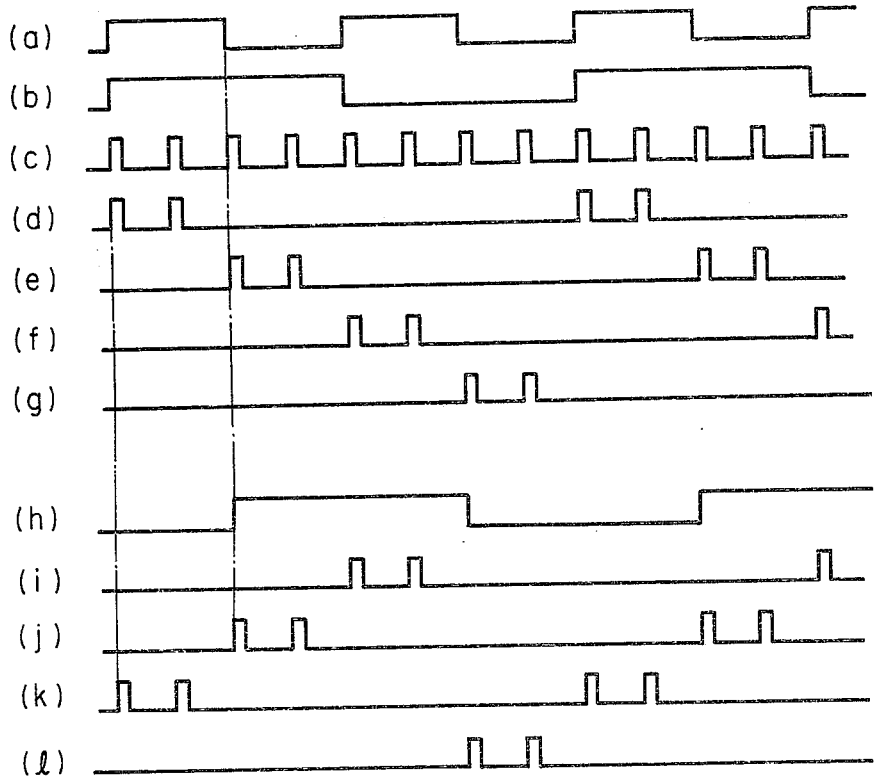
FIGS. 6 (a) through (l) show the waveforms which correspond to the signals of components illustrated in the block diagram shown in FIGS. 4 and 5.

FIG. 6 shows the waveforms of signals produced by the components included in the block diagrams of FIGS. 4 and 5. In FIG. 5 the clock pulse generator 16 generates the clock pulses shown by the waveform in (c) of FIG. 6, and the frequency of the clock pulses is divided, for example, into half by the frequency divider 17. The output of the frequency divider 17 is supplied via the NAND circuit $N_9$ to the digital counter 4 (FIG. 4) as shift clock pulses when the flip-flop circuits 18 and 19 are set. Therefore, a signal exhibiting the waveform shown in (a) of FIG. 6 appears at the output terminal Q of the digital counter 4.

When the circuit 6 for controlling the direction of the self-shift is not actuated, the output at the terminal of the digital counter 4 is applied via NAND circuits $N_1$ and $N_3$ to the digital counter 5, and a signal exhibiting the waveform shown in (b) of FIG. 6 appears at the output terminal Q of the digital counter 4.

When the write signal $W_c$ is applied to the timing control circuit 6, the flip-flop circuit 19 is set and the digital counters 4 and 5 are actuated as mentioned above. The clock pulses sp are supplied from the clock pulse generator 16 to the NAND circuits $N_5$ through $N_8$, and the output of the terminals Q and $\overline{Q}$ of the digital counters 4 and 5 are also supplied to the NAND circuits $N_5$ through $N_8$. Therefore, the shift pulses having wave patterns shown in (d), (e), (f), (g) of FIG. 6 are supplied to the driver 11, and the clock pulses ysp which are shifted 180° by the phase shifter 21 are supplied to the driver 12 so that the voltages ($V_A$ through $V_D$) exhibiting the waveforms shown in FIG. 2 are supplied to discharge points at crosspoints of the row and column electrodes in the panel 9. The write timing pulses wtp are supplied to the WRITE driver 13, and the write pulses corresponding to the write data are supplied to the WRITE electrodes in the panel 19.

The write operation corresponding to one character can be measured by the counter 20 (FIG. 5) which counts the shift clock pulses, that is; the output of the NAND circuit $N_9$. Therefore, when the write operation corresponding to one character is finished, the output of the counter 20 resets the flip-flop circuit 19 and the NAND circuit $N_9$ is closed so that the shift clock pulse is prevented from being sent out. Accordingly, the outputs of the digital counters 4 and 5 each becomes a binary value "1", and the shift pulses are supplied continuously to the bus-line D. As a result, the display condition of the panel becomes stationary.

The information which is a command signal $b_s$ for reversing the direction of self-shift is applied from the keyboard or the like to the control circuit 6, so that the output of the NAND circuit $N_4$ becomes "0". The flip-flop 7 is set at the instant when the output of the NAND circuit $N_4$ is changed from the value "1" to the value "0". The output $f_1$ at the terminal Q of the flip-flop circuit 7 is applied to set terminal S of the flip-flop circuit 18 in FIG. 5. As a result, the shift clock pulses are sent out to the digital counter 4. When the flip-flop circuit 7 is set, the counter 8 begins to count the output pulses of the NAND circuit $N_8$, and the output of the counter 8 becomes "1" at the instant when the counter 8 begins to count the output pulses of the NAND circuit $N_8$. Therefore, the output at the terminal $\overline{Q}$ of the digital counter 4 is supplied via the NAND circuits $N_2$ and $N_3$, to the digital counter 5. The output at the terminal Q of the digital counter 5 exhibits a waveform as shown in (h) of FIG. 6. Therefore, the outputs of the NAND circuits $N_5$, $N_6$, $N_7$ and $N_8$ have the waveforms shown in FIG. 6 as (i), (j), (k) and (1), respectively. The shift pulses are applied to the bus-lines of the panel 9 in accordance with the order of the bus-lines for reversing the direction of the shift (D, C, B, A).

The completion of the reverse shift for one character is recognized by the counter 8 which counts the number of the output pulses produced by the NAND circuit $N_8$. When the counter 8 counts the number of the reverse shift pulses corresponding to one character, the output of the counter 8 becomes "0". Furthermore, the flip-flop circuit 7 is reset at the instant when the output of the counter 8 changes from "1" to "0". Therefore, the flip-flop circuit 18 is reset and the transmission of the shift clock pulses is stopped.

For example, suppose that one character is made up of 5×7 dots, and that two shift pulses are applied at each one of the bus-lines A, B, C and D as shown in FIG. 6, then a hexadecimal (16) counter can be used as the counter 8. When the reverse shift corresponding to one character is completed, then the shift pulses are continuously applied to the bus-line D, and the condition of the display becomes stationary. Next, by entering the correct character, the write operation and forward shift are carried out at the same time.

In the embodiment of the present invention mentioned hereinbefore the amount of the reverse shift corresponds to one character. However, if the command signal $b_s$ is applied again to the control circuit 6, the reverse shift of one more character is carried out. Therefore, a reverse shift corresponding to any number of characters can be carried out.

Figure 7:
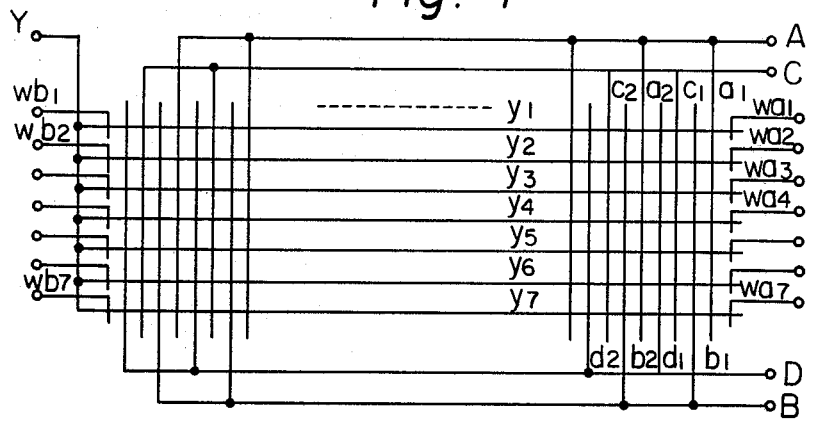
FIG. 7 shows an arrangement of the electrodes in a second embodiment of the self-shift type gas discharge device according to the present invention.

FIG. 7 shows the electrode arrangement in another embodiment of the gas discharge device according to the present invention. Column electrodes $a_i$ through $d_i$ ($i=1, 2, 3, \ldots$) which are connected to bus-lines A, B, C and D and WRITE electrodes $W_{aj}$ and $W_{bj}$ ($j=1, 2, 3, \ldots$) are arranged on one base plate and covered by a dielectric layer. Column electrodes $y_i$ ($i=1, 2, 3, \ldots$) which are commonly connected as shown to a bus-line Y are arranged on another base plate and covered by a dielectric layer. The column electrodes and the WRITE electrodes are arranged to face opposite the row electrodes via a gap filled with discharged gas. The row electrodes and the WRITE electrodes are arranged to cross at right angles to each other as shown in FIG. 7. The characteristic feature of the device shown in FIG. 7 is that the WRITE electrodes are located at both ends of rows electrodes $y_i$.

In the arrangement shown in FIG. 7, when the shift pulses exhibiting the waveforms shown in (d), (e), (f) and (g) of FIG. 6 are supplied to the bus-lines A through D and when WRITE pulses are supplied to the selected WRITE electrodes $W_{aj}$, the discharge spots which are generated can be shifted toward the left. When the shift pulses exhibiting the waveforms shown in (i), (j), (k) and (1) of FIG. 6 are supplied to the bus-lines A through D and at the same time write pulses are supplied to the selected WRITE electrodes $W_{bj}$, the discharge spots can be shifted toward the right. Therefore, the write operation can be carried out at the right end or at the left end of the gas discharge display device in accordance with the information to be displayed.

If the content of the written information is to be displayed in a stationary condition the shift pulses are applied continuously to, for example, the bus-line D so that the discharge spots are generated at discharge points located between the column electrodes $d_i$ and the row electrodes $y_1$. When the shift pulses are supplied alternately to bus-lines C and D, the discharge spots are generated alternately at discharge points located between the column electrodes ($c_i$, $d_i$) and the row electrodes $y_i$. Accordingly, one picture element is displayed by two discharge points.

Figure 8:
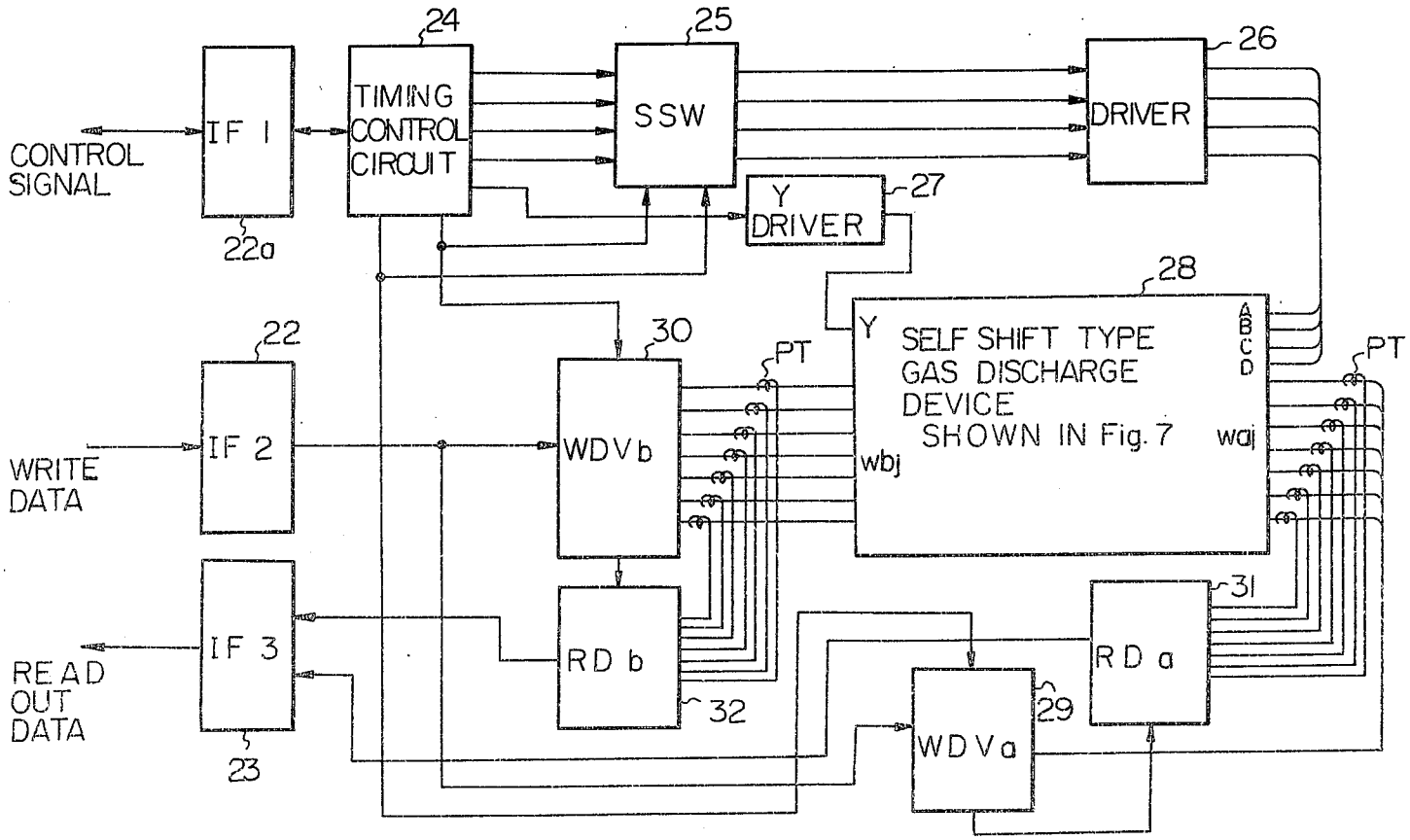
FIG. 8 is a block diagram of a driving circuit according to the present invention for the second embodiment of the discharge device shown in FIG. 7.

Referring to the block diagram in FIG. 8, the driving circuit of the embodiment shown in FIG. 7 comprises interface circuits 22*a*, 22*b* and 23, a timing control circuit 24, a switching circuit 25 for changing the direction of shift, a driver circuit 26 which supplies shift pulses to the bus-lines A through D of the gas discharge display panel, a driver circuit 27 which supplies driving to the bus-line Y, WRITE drivers 29 and 30, READ circuit 31 and 32, and pulse transformers PT.

A write command signal and a WRITE direction command signal are supplied to the interface circuit 22*a*, and WRITE data is applied to the interface circuit 22. When the write direction command signal indicates writing from the right end of the gas discharge display panel, the timing control circuit 24 then applies a control signal to the switching circuit 25 and to the WRITE driver 29 so that the driver 26 can generate shift pulses having a processing order of from the bus-line A to the bus-line D. Accordingly, the WRITE driver 29 applies write pulses to the WRITE electrodes $W_{aj}$ in accordance with the write data. The driver 27 always supplies the pulses to the bus-line Y.

When the write direction command signal indicates writing from the left end of the gas discharge display panel, the timing control circuit 24 applies control signals to the switching circuit 25 and to the WRITE driver 30 so that the driver circuit 26 generates shift pulses which have the processing order from the bus-line D to the bus-line A and so that the WRITE driver 30 applies the write pulses to the WRITE electrodes $W_{bj}$ in accordance with the WRITE data.

When the read command signal and the read direction signal are supplied to the interface 22*a* and the read direction signal indicates that the information is read out by the left shift operation, the timing control circuit 24 controls the driver circuit 26 such that the driver circuit 26 generates shift pulses having the order of from the bus-line A to the bus-line D. In addition, the timing circuit 24 supplies the control signals to the WRITE driver 30 and the READ circuit 32 so that the WRITE driver 30 applies the READ pulses, which are similar to the shift pulses, to all WRITE electrodes $W_{bj}$. When the arrangement of the electrodes is as shown in FIG. 7, the timing of the read-out pulses is the same as the timing of the shift pulses applied to the bus-line D. By applying these read-out pulses, if the discharge spot is generated at the discharge point adjacent to the WRITE electrodes $W_{bj}$, the discharge spot is also generated at the WRITE electrodes $W_{bj}$ and the discharge current flows in the WRITE electrodes. This discharge current is supplied, via the pulse transformer PT, to the READ circuit 32. The read-out data is supplied, via the interface 23, to the information processor (not shown in the drawing).

Figure 9:
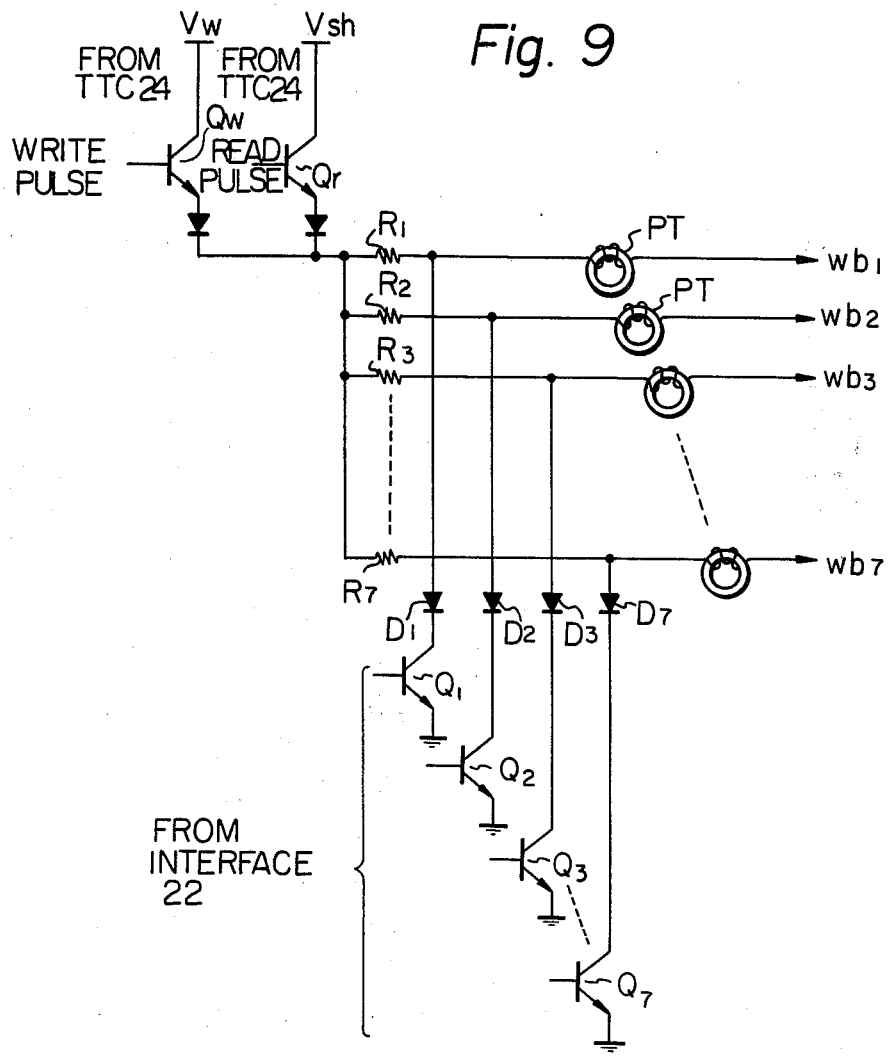
FIG. 9 is a circuit diagram of one embodiment according to the present invention of the WRITE driver shown in the block diagram of FIG. 8.

FIG. 9 shows the circuit diagram of the WRITE driver 30 and the WRITE driver 29 both of which have similar constructions. In the write operation as shown in FIG. 9, a transistor $Q_w$ assumes and "ON" state in the write timing, and transistors $Q_1$ through $Q_7$, therefore, all assume the "ON" state in accordance with the write data. For example, when the WRITE pulse is applied to the WRITE electrode $W_{b2}$, the transistors $Q_1$ and $Q_3$ through $Q_7$ become an "ON" state and the transistor $Q_2$ become asn "OFF" state. Therefore, the write pulse $V_w$ is applied, via the transistor $Q_w$ and a resistor $R_2$, to the WRITE electrode $W_{b2}$, and the WRITE electrodes $W_{b1}$ and $W_{b3}$ through $W_{b7}$ are grounded via the diodes $D_1$ and $D_3$ through $D_7$ and via the transistors $Q_1$ and $Q_3$ through $Q_7$. Consequently, the write pulse is not applied to the WRITE electrodes $W_{b1}$ and $W_{b3}$ through $W_{b7}$.

In the read-out operation, a transistor $Q_r$ assumes the "ON" condition during the read timing, which is the same as that of the shift pulses applied to the bus-line D in FIG. 7. At the same time, the transisotrs $Q_1$ through $Q_7$ become asn "OFF" condition. Therefore, a voltage $V_{sh}$ is applied to the WRITE electrodes $W_{b1}$ through $W_{b7}$. The discharge pulses produced by the voltage $V_{sh}$ are detected by the pulse transformer PT, and the output of the transformer PT is supplied to the read circuit 32.

Figure 10:
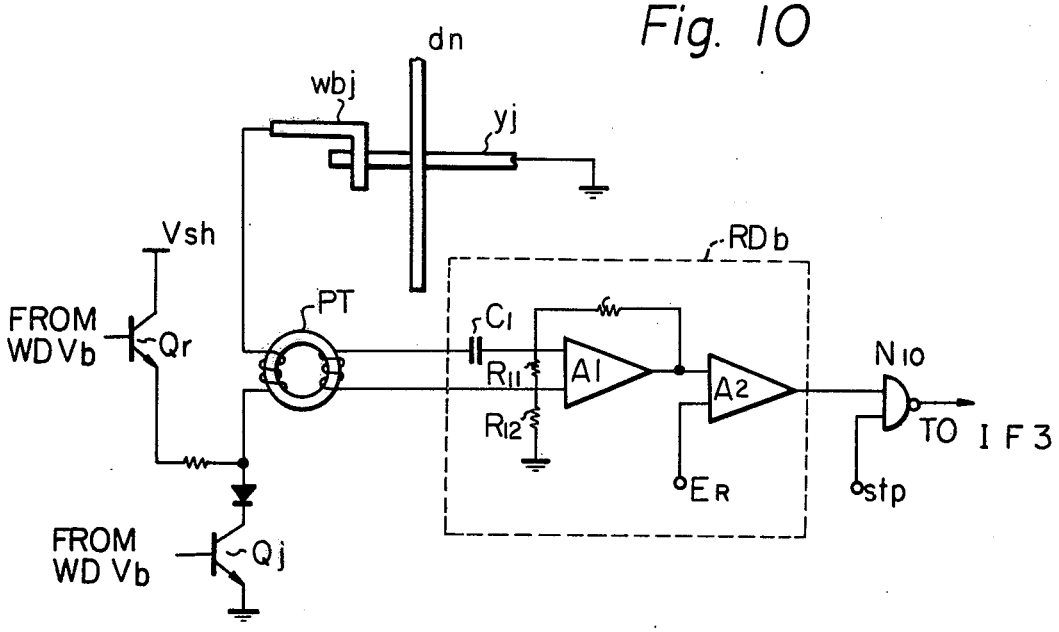
FIG. 10 is a circuit diagram of one embodiment according to the present invention of the READ circuit shown in the block diagram of FIG. 8.
Figure 11:
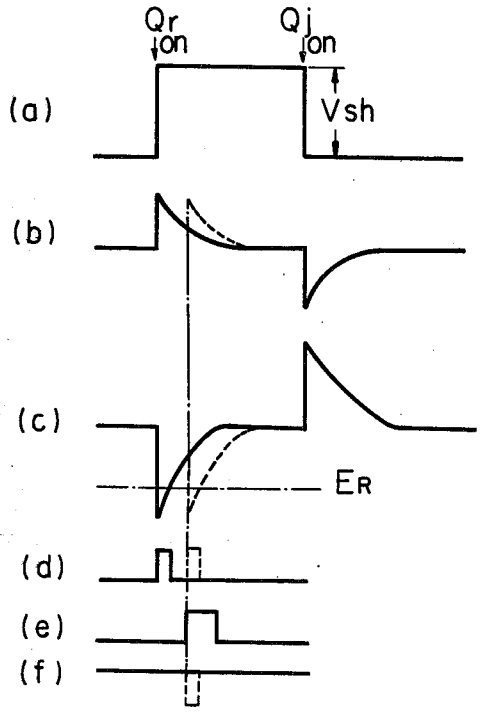
FIGS. 11 (a) through (f) show the waveforms which correspond to the signals produced by the circuit shown in FIG. 10.

FIG. 10 shows a circuit diagram for read circuits 32 and 31 as shown in FIG. 8, both of which have the same construction. When a transistor $Q_j$ assumes an "ON" condition after the voltage $V_{sh}$ is supplied to the WRITE electrode $W_{bj}$ after the transistor $Q_r$ is actuated to an "ON" condition, a read pulse as shown in (a) of FIG. 11 is supplied to the WRITE electrode $W_{bj}$. When the transistors $Q_r$ and $Q_j$ have both become the "ON" condition, the row electrodes $Y_i$ are grounded under the control of the driver 27.

When the read pulse as shown in (a) of FIG. 11 is applied to the WRITE electrode $W_{bj}$, the current as shown in (b) of FIG. 11 flows through the WRITE electrode $W_{bj}$. As the WRITE electrodes have a static capacitance, the charge current flows at a leading edge of the write pulse and the discharge current flows at a trailing edge of the write pulse. If the read pulses are supplied to a column electrode $d_n$ at a timing corresponding to the shift pulses and a discharge spot is generated between the column electrode $d_n$ and the row electrode $Y_i$, a discharge spot is also generated at the WRITE electrode $W_{bj}$. The discharge current in the WRITE electrode $W_{bj}$ is shown by the dotted line in (b) of FIG. 11, because the discharge current in the WRITE electrode is delayed from the leading edge of the write pulse.

The current in the WRITE electrode $W_{bj}$ flows in the primary winding of the pulse transformer PT, the output corresponding to the primary current appears at the secondary winding of the pulse transformer PT, and the output of the pulse transformer PT is amplified by an amplifier $A_1$. The output of the amplifier $A_1$ is shown (c) of FIG. 11. By using a condenser $C_1$, resistors $R_{11}$, $R_{12}$ and $R_{13}$, the output impedance of the secondary winding of the pulse transformer PT becomes nearly zero. Therefore, the input impedance of the pulse transformer can be neglected with respect to the write pulse or the read pulse.

The output of the amplifier $A_1$ and a reference voltage $E_R$ are supplied to an amplifier $A_2$. Accordingly, the output of the amplifier $A_2$ becomes as shown in (d) of FIG. 11. In (d) of FIG. 11, the dotted line shows the detected discharge current pulse when the discharge spot is generated in the WRITE electrode. The output of the amplifier $A_2$ is applied to one input terminal of the NAND circuit $N_{10}$, and the strobe pulse as shown in (e) of FIG. 11 is applied to another input terminal of the NAND circuit $N_{10}$. The strobe pulse stp is applied after the read pulse is applied in accordance with a predetermined time.

The output of the NAND circuit $N_{10}$ is shown in (f) of FIG. 11. When the discharge spot is generated, the pulse shown by the dotted line in (f) of FIG. 11 is obtained at the corresponding WRITE electrode $W_{bj}$ and transferred to the interface 23 as read-out data. During the transfer of the data, read pulses corresponding to one character are converted to a character code. This character code may be transferred to the interface 23.

In the embodiment shown in FIG. 8, two WRITE driver (29, 30) and two READ circuit (31, 32) can be replaced by one WRITE driver and one READ circuit by switching them to the WRITE electrodes $W_{aj}$ and $W_{bj}$ in accordance with the command signal which indicates the write direction and the read direction.

What is claimed is:

1. In a system for controlling the self-shifting of discharge spots comprising a display in a gas discharge device, said device comprising column electrodes connected to a plurality of bus-lines, row electrodes arranged at right angles to and facing said column electrodes across a discharge gap, at least one insulating layer selectively covering said electrodes, and WRITE electrodes arranged respectively near one end of said row electrodes, said system comprising a driver for applying shift pulses to said plurality of said bus-lines, and a WRITE driver for applying write pulses to said WRITE electrodes, the improvement wherein said system comprises control means for shifting said discharge spots in a selected one of forward and reverse directions along said row electrodes, said control means comprising means for stopping said shift in said reverse direction by detecting the reverse shift corresponding to at least one character of said display.

2. In a system for controlling the self-shifting of discharge spots comprising a display in a gas discharge device having column electrodes periodically connected to a plurality of bus-lines, row electrodes arranged at right angles to and facing said row electrodes across a discharge gap to form a discharge cell at each intersection point of said row and column electrodes, and an insulating layer covering at least one of said electrodes of each said discharge cell, the improvement wherein said gas discharge device comprises one group of WRITE electrodes respectively arranged at each of the groups of ends of said row electrodes, and wherein said system comprises a driver for applying shift pulses to said plurality of said bus-lines, a WRITE driver for selectively applying write pulses to said WRITE electrodes for writing information on said discharge cells adjacent to said write electrodes, and control means for controlling the direction of said shifting of said discharge spots in a selected one of forward and reverse directions.

3. The system of claim 1, wherein said control means comprises counter means for counting the pulses applied to said bus-lines, wherein said counter means comprises means for an output when said reverse shift corresponds to a predetermined number of characters for stopping said reverse shift of said display at a selected position.

4. The system of claim 2, wherein said system further comprises read means for detecting a discharge current in said WRITE electrodes by applying read pulses to said WRITE electrodes.

5. The system of claim 1, wherein said row electrodes are connected in common.

6. The system of claim 1, said column electrodes being periodically connected to said plurality of bus-lines.

7. The system of claim 3, said row electrodes being connected in common and said column electrodes being periodically connected to said plurality of bus-lines.

8. The system of claim 2, said row electrodes being connected in common and said column electrodes being periodically connected to said plurality of bus-lines.

9. The system of claim 4, wherein said WRITE driver and said read means comprise portions that are electronically switched to a selected one of said two groups of ends of said row electrodes.

10. The system of claim 4, wherein said read means is inductively coupled to said WRITE driver.

11. The system of claim 1, further comprising a read means adjacent to each of selected ones of said discharged cells for detecting a discharge current in each of said selected discharge cells.

* * * * *

UNITED STATES PATENT AND TRADEMARK OFFICE

CERTIFICATE OF CORRECTION

PATENT NO. : 4,149,112

DATED : April 10, 1979

INVENTOR(S) : Hirohide Miwa et al

It is certified that error appears in the above-identified patent and that said Letters Patent are hereby corrected as shown below:

Column 1, line 42, "in u.s.a." should be --in U.S.A.--.
Column 3, line 20, "having" should be --being--.
Column 7, line 1, "asn" should be --an--.
Column 7, line 12, "asn" should be --an--.
Column 7, line 50, after "shown" insert --in--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*